United States Patent [19]

Takada et al.

[11] 4,168,977

[45] Sep. 25, 1979

[54] SILVER HALIDE PHOTOGRAPHIC EMULSION

[75] Inventors: Shunji Takada; Yoshitaka Akimura; Hiroyuki Mifune; Nobuyuki Tsujino, all of Minami-ashigara, Japan

[73] Assignee: Fuji Photo Film Co., Ltd., Minami-ashigara, Japan

[21] Appl. No.: 823,881

[22] Filed: Aug. 11, 1977

[30] Foreign Application Priority Data

Aug. 11, 1976 [JP] Japan ..... 51/96337
Nov. 11, 1976 [JP] Japan ..... 51/135562

[51] Int. Cl.[2] ..... G03C 5/24; G03C 5/30; G03C 1/06; G03C 1/28

[52] U.S. Cl. ..... 96/63; 96/66.3; 96/95; 96/107; 96/109

[58] Field of Search ..... 96/107, 109, 95, 67, 96/66.3, 63

[56] References Cited

U.S. PATENT DOCUMENTS

| | | | |
|---|---|---|---|
| 2,286,662 | 6/1942 | Weyde | 96/107 |
| 2,419,975 | 5/1947 | Trivelli et al. | 96/107 |
| 3,386,831 | 6/1968 | Honig et al. | 96/109 |
| 3,447,927 | 6/1969 | Bacon | 96/107 |
| 3,730,727 | 5/1973 | Olivares et al. | 96/95 |
| 3,782,949 | 1/1974 | Olivares et al. | 96/95 |
| 3,793,027 | 2/1974 | Okutsu et al. | 96/66.3 |
| 4,030,925 | 6/1977 | Leone et al. | 96/107 |

*Primary Examiner*—Mary F. Kelley
*Attorney, Agent, or Firm*—Sughrue, Rothwell, Mion, Zinn and Macpeak

[57] ABSTRACT

A negative image silver halide photographic emulsion comprising substantially surface latent image-type silver chlorobromide or silver chlorobromoiodide grains with an iodide content of up to about 7 mol%, wherein the mean grain size of the silver halide grains is not greater than about 0.7$\mu$, a binder is present in an amount of not more than about 250 g per mol of silver halide, and at least one compound represented by the following general formula (I):

$$R^1NHNHCHO \qquad (I)$$

wherein $R^1$ represents an aryl group.

12 Claims, No Drawings

SILVER HALIDE PHOTOGRAPHIC EMULSION

BACKGROUND OF THE INVENTION

1. Field of the Invention

The present invention relates to a silver halide photographic emulsion and, more particularly, to a photographic emulsion providing an extremely contrasty negative image photographic property. Further, the present invention relates to a process for forming images and, more particularly, to a process for forming photographic images with an extremely contrasty negative image.

2. Description of the Prior Art

U.S. Pat. No. 2,419,975 describes a process for obtaining a contrasty negative image photographic property by adding a hydrazine compound. The disclosure in this U.S. patent is that an extremely contrasty photographic property of a gamma($\gamma$) of more than 10 can be obtained by adding a hydrazine compound to a silver chlorobromide emulsion and developing the emulsion with a developer having a pH as high as 12.8. However, a strongly alkaline developer whose pH is near 13 tends to be oxidized by air and is so unstable that it cannot be stored or used for a long time.

A super-contrasty photographic property of a gamma of more than 10 is extremely useful for photographic reproduction of continuous tone images through dot images which are useful for making printing plates regardless of whether the image is negative or positive, or useful for reproduction of line images. For such a purpose, the process comprising using a silver chlorobromide photographic emulsion containing more than about 50 mol%, preferably more than 75 mol%, of silver chloride and developing the emulsion with a hydroquinone developer wherein the effective concentration of sulfite ion is controlled to an extremely low level (usually not more than about 0.1 mol/l) has generally been employed. However, this process has the defect that, since the sulfite ion concentration in the developer is low, the developer is extremely unstable and cannot be stored for longer than about 3 days. In addition, a high sensitivity cannot be obtained with a silver chlorobromide emulsion containing a slight amount of silver bromide. Therefore, it has strongly been desired to obtain a super-contrasty photographic property useful for the reproduction of dot images or line images using a highly sensitive emulsion and a stable developer.

SUMMARY OF THE INVENTION

An object of the present invention is to provide a silver halide photographic emulsion with which an extremely contrasty negative image photographic property can be obtained using a stable developer.

Another object of the present invention is to provide a highly sensitive silver halide photographic emulsion capable of providing an extremely contrasty negative image photographic property.

A further object of the present invention is to provide a process for forming photographic images having an extremely contrasty negative image photographic property by using a stable developer.

Still a further object of the present invention is to provide a process for forming photographic images capable of providing, with high sensitivity, an extremely contrasty negative image photographic property.

Still a further object of the present invention is to provide a process for forming extremely contrasty negative photographic images with extremely less fog.

The above-described objects are attained by incorporating, in a silver halide photographic emulsion which comprises substantially surface latent image-type silver chlorobromide or silver chlorobromoiodide grains which have a mean particle size of not more than about 0.7$\mu$ and in which the silver chlorobromoiodide grains contain about 7 mol% or less silver iodide based on the total silver halide amount with the silver halide photographic emulsion containing a binder in an amount of not more than about 250 g per mol of silver halide, and at least one compound represented by the following general formula (I):

$$R^1NHNHCHO \qquad (I)$$

wherein $R^1$ represents an aryl group.

The above-described objects are attained in another embodiment by developing, after image-wise exposure, a photographic light-sensitive material containing at least one silver halide photographic emulsion layer which comprises substantially surface latent image-forming type silver chlorobromide or silver chlorobromoiodide grains which have a mean particle size of about 0.7$\mu$ or less and in which the silverchlorobromide grains contain up to about 7 mol% silver iodide and which contains a binder in an amount of not more than about 250 g per mol of silver halide, and containing the compound represented by the general formula (I) above in the silver halide photographic emulsion layer or in at least one other hydrophilic colloidal layer, using a developer containing about 0.15 mol/l or more sulfite ion in the presence of a benzotriazole compound at a pH of 11.0 to 12.3.

DETAILED DESCRIPTION OF THE INVENTION

In the general formula (I) above, $R^1$ represents a monocyclic or bicyclic aryl group. A suitable example of a monocyclic aryl group for $R^1$ is a phenyl group and a suitable example of a bicyclic aryl group for $R^1$ is a naphthyl group. The aryl group may be substituted with one or more substituents which are not electron-attracting, such as alkyl groups having 1 to 20 carbon atoms (which may be straight or branched chained, e.g., methyl, ethyl, propyl, isopropyl, n-butyl, isobutyl, n-octyl, n-hexyl, tert-octyl, n-decyl, n-dodecyl, etc.), aralkyl groups having 1 to 3 carbon atoms in the alkyl moiety thereof (e.g., benzyl, phenethyl, etc.), alkoxy groups having 1 to 20 carbon atoms (in which the alkyl moiety may be straight or branched chain, e.g., methoxy, ethoxy, 2-methylpropyloxy, etc.), amino groups which are mono- or disubstituted with alkyl groups having 1 to 20 carbon atoms, aliphatic acylamino groups having 2 to 21 carbon atoms or aromatic acylamino groups (e.g., acetylamino, octynylamino, benzoylamino, dimethylamino, etc.), etc.

Specific examples of the substituents represented by $R^1$ include a phenyl group, an $\alpha$-naphthyl group, a $\beta$-naphthyl group, a p-tolyl group, an m-tolyl group, an o-tolyl group, a p-methoxyphenyl group, an m-methoxyphenyl group, a p-dimethylaminophenyl group, a p-diethylaminophenyl group, a p-(acetylamino)phenyl group, a p-(heptylcarbonylamino)phenyl group, a p-

(benzoylamino)phenyl group, a p-benzylphenyl group, etc.

Of the above-described substituents represented by $R^1$, monocyclic aryl groups are preferred, with an unsubstituted phenyl group and a tolyl group being particularly preferred.

The silver halide grains which can be used in the present invention are substantially surface latent image-type silver halide grains. In other words, they are not substantially internal latent image-type silver halide grains. In the present invention, "substantially surface latent image-type" is defined as the condition where, on developing, after exposure for about 1 to about 1/100 second, according to Surface Development (A) and Internal Development (B) to be described hereinafter, the sensitivity obtained by Surface Development (A) is greater than that obtained by Internal Development (B). Sensitivity as used herein is defined as follows:

$$S = 100/Eh$$

wherein S represents the sensitivity and Eh represents the exposure amount necessary for obtaining a density just intermediate the maximum density ($D_{max}$) and the minimum density ($D_{min}$), i.e., $\frac{1}{2}(D_{max}+D_{min})$.

Surface Development (A)

Development is conducted for 10 minutes at 20° C. in a developer of the following formulation.

| | | |
|---|---|---|
| N-Methyl-p-aminophenol (hemisulfate) | 2.5 | g |
| Ascorbic Acid | 10 | g |
| Sodium Metaborate (tetrahydrate) | 35 | g |
| Potassium Bromide | 1 | g |
| Water to make | 1 | l |

Internal Development (B)

The light-sensitive material is processed for 10 minutes at about 20° C. in a bleaching solution containing 3 g/l of potassium ferricyanide and 0.0125 g/l of phenosafranine and, after washing for 10 minutes, developed for 10 minutes at 20° C. in a developer of the following formulation.

| | | |
|---|---|---|
| N-Methyl-p-aminophenol (hemisulfate) | 2.5 | g |
| Ascorbic Acid | 10 | g |
| Sodium Metaborate (tetrahydrate) | 35 | g |
| Potassium Bromide | 1 | g |
| Sodium Thiosulfate | 3 | g |
| Water to make | 1 | l |

If the emulsion of the present invention were not of substantially surface latent image-type, a positive image in addition to a negative image would be obtained.

The silver halide grains which can be used in the present invention should not have a mean particle size of greater than about 0.7μ. The term "mean particle size" is a well known and easily understandable technical term commonly used by those skilled in the art of silver halide photography. Where the grains are spherical or can be considered to be approximately spherical, the particle size means the particle diameter. With cubic grains, the edge length$\times\sqrt{4/\pi}$ is taken as the particle size. The mean particle size is determined as an algebraic or geometric mean based on the projected areas of particles. The details of a method for determining mean particle size are described in C.E.K. Mees and T.H. James, *The Theory of the Photographic Process*, 3rd Ed., pp. 36–43, Macmillan Co., New York (1966).

If the mean particle size of the grains in the emulsion of the present invention exceeds about 0.7μ, a sufficient increase in contrast cannot be obtained. A mean particle size of not more than 0.4μ is more preferred. With the emulsion of the present invention, even though the mean particle size of the grains is small, a high sensitivity can be obtained.

Either of silver chlorobromide or silver chlorobromoiodide is used as the silver halide. The amount of silver chloride is preferably not more than about 80 mol% and, with silver chlorobromoiodide, the content of silver iodide is preferably not more than about 7 mol%. The amount of silver chloride is particularly preferably not more than about 50 mol%, and the content of silver iodide is particularly preferably not more than about 6 mol%. In general, surface latent image-forming type silver halide emulsions can be prepared by chemical sensitization such as sulfur sensitization, reduction sensitization, noble metal sensitization or a combination thereof.

The emulsion of the present invention must not contain more than about 250 g of a binder per mol of silver halide. A suitable amount of binder can range from about 20 g to about 250 g per mol of silver halide. If more than about 250 g of a binder is present in the emulsion, a contrasty photographic property, in particular an extremely contrasty photographic property of a gamma exceeding 10 as intended in the present invention, cannot be obtained. A general tendency is that, the less the amount of the binder in an emulsion, the greater the contrast. This is the effect based on the amount of silver halide present in a silver halide emulsion layer of a unit thickness. The influence of the amount of silver halide in the present invention is different from that in known cases, and the effects on gradation greatly change around the above-described amount of binder. The effects of the present invention can be obtained only by using silver halide grains having a mean particle size of not more than about 0.7μ and by incorporating a greater amount of silver halide in an emulsion.

Gelatin can be advantageously used as the binder or protective colloid for the photographic emulsion. However, other hydrophilic colloids can be used as well. For example, proteins such as gelatin derivatives, graft polymers between gelatin and other high polymers, albumin, casein, etc.; cellulose derivatives such as hydroxyethyl cellulose, carboxymethyl cellulose, cellulose sulfates, etc.; saccharide derivatives such as sodium alginate, starch derivatives, etc.; and various synthetic hydrophilic high polymers of homo- or copolymers such as polyvinyl alcohol, partially acetaled polyvinyl alcohol, poly-N-vinylpyrrolidone, polyacrylic acid, polymethacrylic acid, polyacrylamide, polyvinylimidazole, polyvinylpyrazole, etc., can be used as the binder or protective colloid for the photographic emulsion.

Acid-processed gelatin may be used as well as lime-processed gelatin as the gelatin. In addition, the hydrolyzed products of gelatin and enzyme-decomposed products of gelatin are also suitable. Suitable gelatin derivatives which can be used include those obtained by reacting gelatin with various compounds such as acid halides, acid anhydrides, isocyanates, bromoacetic acid, alkanesulfones, vinylsulfonamides, maleinimides, polyalkylene oxides, epoxy compounds, etc. Specific examples thereof are described in U.S. Pat. Nos. 2,614,928, 3,132,945, 3,186,846, 3,312,553, British Patent Nos.

861,414, 1,033,189, 1,005,784, Japanese Patent Publication No. 26,845/67.

As the above-described gelatin graft polymer, those which are obtained by grafting homo- or copolymers of vinyl monomers such as acrylic acid, methacrylic acid, the ester or amide derivatives thereof, acrylonitrile, styrene, etc., to gelatin can be used. In particular, graft polymers with a polymer having some compatibility with gelatin, such as polymers of acrylic acid, methacrylic acid, acrylamide, methacrylamide, hydroxyalkyl methacrylate, etc., are preferred. Examples thereof are described in U.S. Pat. Nos. 2,763,625, 2,831,767, 2,956,884, etc. Typical synthetic hydrophilic materials are described in, e.g., West German Pat. No. 2,312,708, U.S. Pat. Nos. 3,620,751, 3,879,205 and Japanese Patent Publication No. 7,561/68.

Although the silver halide emulsions used in the present invention need not necessarily be chemically sensitized, chemically sensitized silver halide emulsions are preferred. Processes for chemical sensitization of the silver halide emulsions which can be used include known sulfur sensitization, reduction sensitization and noble metal sensitization processes. These processes are described in references such as P. Grafkides, *Chimie et Phisique Photographique,* Paul Montel, Paris (1967) or Zelikmann, *Making and Coating Photographic Emulsions,* The Focal Press, London (1964) or H. Frieser, *Die Gründlagen der photographischen Prozesse mit Silberhalogeniden,* Akademische Verlagsgesellschaft, (1968) In the noble metal sensitization processes, a gold sensitization process is a typical process where gold compounds or mainly gold complexes are used. However, if the gold sensitizing agents are used in an amount effective to carry out chemical sensitization, a softening of the tone occurs. Accordingly, gold sensitization is not as suitable for the present invention. No difficulties occur using complexes of noble metals other than gold, such as those of platinum, palladium or iridium, etc. A reduction sensitization process may be used if the process does not generate a fog which causes practical difficulties. However, reduction sensitization is not as preferred because control of the process conditions is difficult. A preferred chemical sensitization process for the present invention is the use of a sulfur sennsitization process. In the present invention, it is preferred for the silver halide emulsions substantially not to be subjected to gold sensitization and it is particularly preferred for the silver halide emulsions to be chemically sensitized using only a sulfur sensitization process.

Examples of sulfur sensitizing agents which can be used include not only sulfur compounds present in the gelatin per se but also various sulfur compounds such as thiosulfates, thioureas, thiazoles or rhodanines, etc. Examples of suitable sulfur compounds are described in U.S. Pat. Nos. 1,574,944, 2,410,689, 2,278,947, 2,728,668 and 3,656,955. Typical examples of reduction sensitizing agents which can be used include stannous salts, amines, formamidine sulfinic acid and silane compounds, etc., as described in U.S. Pat. Nos. 2,487,850, 2,518,698, 2,983,609, 2,983,610 and 2,694,637. Complex salts of Group VIII metals in the Periodic Table, such as platinum, iridium or palladium, etc., can be used for noble metal sensitization and examples thereof are described in U.S. Pat. No. 2,448,060 and British Patent No. 618,061, etc.

Specific examples of compounds represented by the general formula (I) above are illustrated below. However, the present invention is not to be construed in any way as being limited to these specific examples.

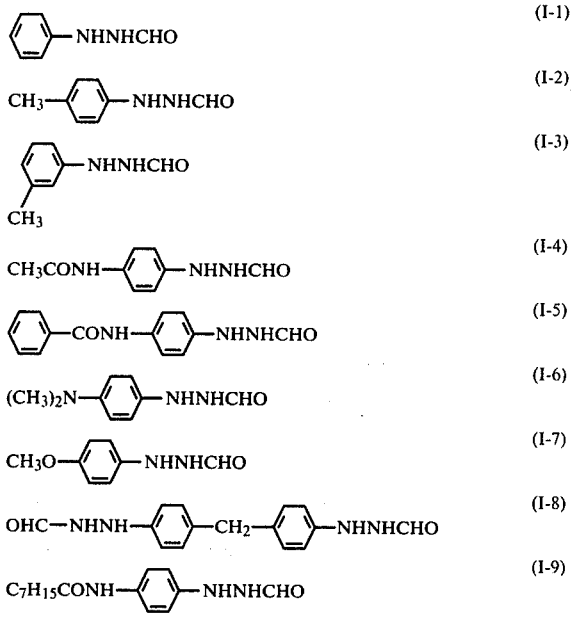

The compounds represented by the general formula (I) can be synthesized by reacting hydrazines with formic acid or a formic acid ester. Starting material hydrazines such as

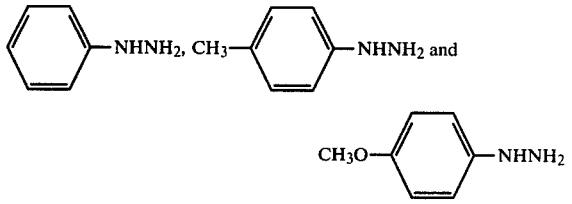

are commercially available and hydrazines of the formula

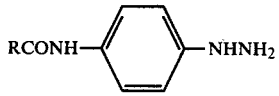

where R represents an alkyl group can be synthesized by reduction of a p-nitrophenyl hydrazine. The reaction can be conducted without a solvent and at a temperature of about 0° C. to about 100° C., preferably 0° C. to 70° C. A suitable molar ratio of the hydrazine to formic acid is about 1:1 or more.

A specific example of the synthesis of the compounds represented by the general formula (I) is shown below. Unless otherwise indicated herein, all parts, percents, ratios and the like are by weight.

Synthesis of Compound 2

110 g of formic acid was stirred at 25°-30° C., and 107 g of p-tolylhydrazine was added thereto incrementally. After completion of the addition, the mixture was heated at 50° C. for 20 minutes under stirring. After cooling with ice, the crystals formed were filtered out, then recrystallized from 550 ml of acetonitrile. Thus, 54.5 g of colorless needlelike crystals having a melting point of 176°-177° C. was obtained.

The compound of the general formula (I) is usually incorporated in the photographic emulsion of the present invention in an amount of about $10^{-4}$ to about $10^{-1}$ mol/mol Ag. An amount of $3\times10^{-3}$ to $5\times10^{-2}$ mol/mol Ag is preferred, with the amount of $5\times10^{-3}$ to $5\times10^{-2}$ mol/mol Ag being particularly preferred.

The addition of the compound represented by the general formula (I) can be carried out using conventional methods of adding additives to photographic emulsions. For example, the compound can be added to the emulsions as an aqueous solution having a suitable concentration where the compound is water-soluble or as a solution in an organic solvent compatible with water such as alcohols, ethers, glycols, ketones, esters or amides which do not adversely influence the photographic properties where the compound is insoluble or poorly soluble in water. Known methods similar to the addition of water-insoluble couplers (the so-called oil-soluble couplers) to emulsions as a dispersion can be used too.

The compounds of the general formula (I) to be used in the present invention are characterized in that, when incorporated in a silver halide emulsion, the effect of making an emulsion contrasty and the sensitizing effect are maintained stable with the lapse of time. From this standpoint, the compounds of the general formula (I) are markedly superior to known compounds in producing a contrasty emulsion such as unsubstituted hydrazine salts, alkoxycarbonylhydrazines, etc.

The photographic emulsions of the present invention can be prepared by processes described in P. Grafkides, *Chimie et Physique Photographique,* Paul Montel Co., Paris (1967), G. F. Duffin, *Photographic Emulsion Chemistry,* The Focal Press, London (1966) and V. L. Zelikman et al., *Making and Coating Photographic Emulsions,* The Focal Press, London (1964). Namely, they may be prepared by any of an acid process, a neutral process or an ammonia process. Further, a single-jet process, a double-jet process or a combination thereof may be used as a process of reacting soluble silver salts with soluble halide salts.

A process of forming grains under conditions where an excess of silver ion (the so-called reverse mixing process is present can also be used. One type of double-jet mixing process which can be used is a process which comprises holding the pAg constant in a liquid phase where silver halide is formed, namely, the so-called controlled double-jet process. According to this process, silver halide emulsions having a regular crystal form and a uniform grain size can be obtained.

The silver halide grains in the photographic emulsions of the present invention may have a comparatively wide grain size distribution. However, a narrow grain size distribution is preferred. It is particularly preferred for 90% by weight or number based on the total silver halide grains to have a grain size in a range of ±40% of the average grain size (generally, such an emulsion is called a monodispersed emulsion).

The silver halide grain in the photographic emulsions of the invention may have a regular form such as a cubic form or an octahedral form. Further, they may have an irregular crystal form such as that of a sphere or a plate, etc., or they may have a complex form of these crystal forms.

The silver halide grains may have a structure in which the inner part and the outer part are each composed of a different phase or may have a structure which is uniform throughout.

In forming silver halide grains or during physical ripening, cadmium salts, zinc salts, lead salts, thalium salts, iridium salts or complexes thereof, rhodium salts or complexes thereof, or iron salts or complexes thereof, etc., may also be present.

Two or more silver halide emulsions produced separately may be used by mixing them, if desired.

The soluble salts are generally removed from the emulsion after formation of the precipitates or after physical ripening. A well known noodle water washing process which is carried out after gelling of the gelatin may be used for this purpose. Further, flocculation processes utilizing inorganic salts containing a polyvalent anion, such as sodium sulfate, anionic surface active agents, anionic polymers (such as polystyrene sulfonic acid) or gelatin derivatives (such as aromatic acylated gelatins, aliphatic acylated gelatins or aromatic carbamoylated gelatins, etc.) can be used. The removal of the soluble salts may be omitted, if desired.

Although emulsions which are not chemically sensitized (a so-called primitive emulsion) may be used as the silver halide emulsions, they are usually chemically sensitized.

The silver halide emulsions of the present invention may contain anti-fogging agents. Such emulsions are preferred in order to attain the objects of the present invention. Examples of preferred anti-fogging agents which can be used in the emulsions of the present invention include 1,2,3-triazole, compounds, 3-mercapto substituted 1,2,4-triazole compounds, 2-mercaptobenzimidazole compounds (which should be unsubstituted with a nitro group), 2-mercaptopyrimidines, 2-mercaptobenzothiazoles, benzothiazolium compounds (for example, N-alkylbenzothiazolium halide or N-allylbenzothiazolium halide) and 2-mercapto-1,3,4-thiadiazoles, etc.

Particularly advantageous anti-fogging agents for use in the present invention are benzotriazoles. The benzene ring of the benzotriazoles may be substituted with one or more substituents selected from an alkyl group (e.g., a methyl group, a heptyl group, etc.), a halogen atom (e.g., a chlorine atom, a bromine atom, etc.), an alkoxy group (e.g., a methoxy group, etc.), an acyl group (e.g., an acetyl group, a benzoyl group, etc.), an acylamino group (e.g., an acetylamino group, a capryloylamino group, a benzoylamino group, a benzenesulfonylamino group, etc.), a carbamoyl group (e.g., a methylcarbamoyl group, a phenylcarbamoyl group, etc.), a sulfamoyl group (e.g., a methylsulfamoyl group, a phenylsulfamoyl group, etc.), an aryl group (e.g., a phenyl group, a tolyl group, etc.), etc. The alkyl moiety in these substituents preferably contains 12 or less carbon atoms, particularly preferably 3 or less carbon atoms. In addition, the benzotriazole compounds may be substituted with a halogen atom (e.g., a chlorine atom, a bromine atom, etc.) in the 1-position thereof.

Benzotriazoles, which are particularly effective anti-fogging agents for the present invention, can be represented by the following general formula (II):

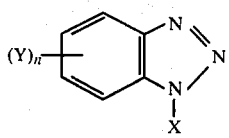

(II)

wherein Y represents an alkyl group having 1 to 12 carbon atoms (for example, a methyl group, a heptyl group or a decyl group), a halogen atom (for example, a chlorine atom or a bromine atom), an alkoxy group having 1 to 12 carbon atoms (for example, a methoxy group or a lauryloxy group), an acyl group having 2 to 13 carbon atoms (for example, an acetyl group or a benzyl group), an acylamino group having 2 to 13 carbon atoms (for example, an acetylamino group, a caproylamino group, a benzoylamino group or a benzenesulfonylamino group), a carbamoyl group which may be substituted with an aliphatic or aromatic group having up to 12 carbon atoms (for example, a methylcarbamoyl group or a phenylcarbamoyl group), a sulfamoyl group which may be substituted with an aliphatic or aromatic group having up to 12 carbon atoms (for example, a methylsulfamoyl group or a phenylsulfamoyl group) or a monocyclic or bicyclic aryl group (for example, a phenyl group). Y does not represent a nitro group. n represents 0, 1 or 2. Where n is 2, Y may be the same or different. The alkyl moiety in the Y group preferably has 1 to 3 carbon atoms. X represents a hydrogen atom, a halogen atom (for example, a chlorine atom or a bromine atom) or an acyl group having 1 to 10 carbon atoms (for example, an acetyl group or a propionyl group).

Examples of suitable compounds represented by the general formula (II) which can be used in this invention are described below. However, the present invention is not to be construed as being limited to these compounds.

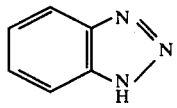

(II-1)

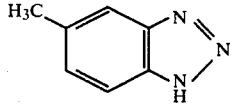

(II-2)

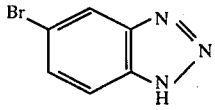

(II-3)

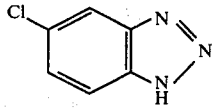

(II-4)

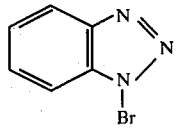

(II-5)

-continued

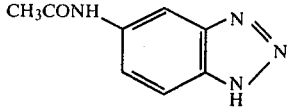

(II-6)

The benzotriazole compounds represented by the general formula (II) can be synthesized by reference to, for example, the disclosure in *Organic Synthesis,* Vol. 3, page 106; *Journal of the Chemical Society,* Vol. 119, pages 2088–94 (1921); ibid., pages 1143–53 (1931) or ibid., Section C, pages 1474–78 (1969), etc.

In order to conduct the development in the process of the present invention in the presence of the benzotriazoles, they may be incorporated in the light-sensitive material, the light-sensitive material may be treated with a solution of the benzotriazole compound before development or the benzotriazole compound may be added to a developer.

In the image-forming process of the present invention, the benzotriazole compound may be incorporated, suitably, in one or more hydrophilic colloid layers of the photographic material. The benzotriazole compound may be incorporated in a light-sensitive emulsion layer or may be incorporated in a non-light-sensitive hydrophilic colloid layer. Where the benzotriazole compound is incorporated into a light-sensitive emulsion layer, although it is preferred for the emulsion layer to which such is added to be a silver halide emulsion layer essentially of the type used in the present invention, it may be incorporated into another type of silver halide emulsion layer. The benzotriazole compound may be incorporated into a single silver halide emulsion layer or may be incorporated into two or more silver halide emulsion layers. Where the benzotriazole compound is incorporated into a non-light-sensitive hydrophilic colloid layer, the layer may be any of an intermediate layer, a protective layer, a back layer and a layer between the silver halide emulsion layer and the support (under layer). The benzotriazole compound, however, is preferably incorporated into a layer adjacent the silver halide emulsion layer as used in the present invention.

In the image-forming process of the present invention, the benzotriazole compound may be added to the developing solution. When the benzotriazole compound is added to the developing solution, it is added as a solution in a solvent compatible with water, such as an alcohol (for example, methanol or ethanol), a ketone (for example, acetone or methyl ethyl ketone) or an ester (for example, ethyl acetate) or as an aqueous solution during or after preparation of the developing solution. These solvents may be used, as desired, in an alkaline state or an acid state.

The photographic materials may be processed using a bath containing a benzotriazole compound before development and after exposure to light.

A preferred amount of the benzotriazole compound in the photographic emulsion ranges from about $10^{-4}$ to $10^{-1}$ mol/mol Ag. An amount of $10^{-3}$ to $3\times10^{-2}$ mol/mol Ag is particularly preferred.

Where the benzotriazole compound is incorporated into a non-light-sensitive hydrophilic colloid layer, a benzotriazole compound is preferably present in the above-described amount based on the amount of the silver salt in the same area.

Where the benzotriazole compound is added to the developing solution, an amount of about $10^{-6}$ to about $10^{-1}$ mol/liter of the developing solution is preferred, particularly an amount of $3\times10^{-5}$ to $3\times10^{-2}$ mol/liter of the developing solution is preferred.

Addition of a small amount of an iodide (e.g., potassium iodide, etc.) after formation of the silver halide grains, before chemical ripening, after chemical ripening, or before coating serves to enhance further the effects of the present invention. Such iodide is suitably added in an amount of about $10^{-4}$ to about $10^{-2}$ mol/mol Ag.

The photographic emulsions of the present invention may be spectrally sensitized with methine dyes or the like. Examples of suitable dyes which can be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. These dyes may contain nuclei commonly used as basic heterocyclic nuclei in cyanine dyes. Namely, a pyrroline nucleus, an oxazoline nucleus, a thiazoline, nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc., can be employed. These nuclei may be substituted with substituents on the carbon atoms thereof.

The merocyanine dyes or complex merocyanine dyes may contain 5- or 6-membered heterocyclic rings such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

Useful sensitizing dyes are those described in German Patent No. 929,080, U.S. Pat. Nos. 2,231,658, 2,493,748, 2,503,776, 2,519,001, 2,912,329, 3,656,959, 3,672,897 and 3,694,217, British Patent No. 1,242,588 and Japanese Patent Publication No. 14030/69.

These sensitizing dyes may be used individually or as a combination thereof. Combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Patent No. 1,344,281 and Japanese Patent Publication No. 4936/68.

The emulsions may contain dyes which do not have a spectral sensitization function themselves or materials which do not substantially absorb visible light but give rise to a supersensitization together with the sensitizing dyes. For example, aminostilbene compounds substituted with a nitrogen-containing heterocyclic group (such as those described in, for example, U.S. Pat. Nos. 2,933,390 and 3,635,721), aromatic organic acid-formaldehyde condensation products (for example, those described in U.S. Pat. No. 3,743,510), cadmium salts and azaindene compounds may be employed. The combinations described in U.S. Pat. Nos. 3,615,613, 3,615,641, 3,617,295 and 3,635,721 are particularly useful.

The photographic emulsions of the present invention may contain water-soluble dyes as filter dyes or for the purpose of preventing irradiation or for other purposes. Examples of such dyes include oxonol dyes, hemioxonol dyes, styryl dyes, merocyanine dyes, cyanine dyes and azo dyes. Above all, oxonol dyes, hemioxonol dyes and merocyanine dyes are particularly preferred. Examples of these dyes which can be used include those described in British Pat. Nos. 584,609 and 1,177,429, Japanese Patent Applications (OPI) No. 85130/73, 99620/64 and 114420/64, and U.S. Pat. Nos. 2,274,782, 2,533,472, 2,956,879, 3,148,187, 3,177,078, 3,247,127, 3,540,887, 3,575,704, 3,653,905 and 3,718,472.

The photographic emulsions of the present invention may contain inorganic or organic hardening agents. For example, chromium salts (chrome alum or chromium acetate, etc.), aldehydes (formaldehyde, glyoxal or glutaraldehyde, etc.), N-methylol compounds (dimethylolurea or methyloldimethylhydantoin, etc.), dioxane derivatives (2,3-dihydroxydioxane, etc.), active vinyl compounds (1,3,5-triacryloylhexahydro-s-triazine or bis(vinylsulfonyl) methyl ether, etc.), active halogen compounds (2,4-dichloro-6-hydroxy-s-triazine, etc.), mucohalic acids (mucochloric acid or mucophenoxychloric acid, etc.), isoxazoles, dialdehyde starch and 2-chloro-6-hydroxytriazinyl gelatin, etc., which may be used individually or in a combination of two or more thereof. Examples of suitable hardening agents include those described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Patent Nos. 676,628, 825,544 and 1,270,578, German Patent Nos. 872,153 and 1,090,427 and Japanese Patent Publication Nos. 7133/59 and 1872/71.

The photographic emulsions of the present invention may contain various known surface active agents for various purposes, e.g., as a coating aid, for preventing the generation of electrostatic charges, for improving lubricating properties, for emulsifying or dispersing, for preventing adhesion and for improving the photographic properties (for example, acceleration of development, hardening or sensitization), etc.

Examples of suitable surface active agents include nonionic surface active agents such as saponin (steroid type), alkylene oxide derivatives (for example, polyethylene glycol, polyethylene glycol-polypropylene glycol condensation products, polyethylene glycol alkyl or alkylaryl ethers, polyethylene glycol esters, polyethylene glycol sorbitan esters, polyalkylene glycol alkylamines or amides or polyethylene oxide addition products of silicones, etc.), glycidol derivatives (for example, alkenylsuccinic acid polyglycerides or alkylphenol polyglycerides), aliphatic acid esters of polyhydric alcohols, alkyl esters of saccharides, urethanes of saccharides or ethers of saccharides, etc.; anionic surface active agents containing acid groups such as a carboxyl group, a sulfo group, a phospho group, a sulfate group or a phosphate group, etc., such as triterpenoid type saponin, alkylcarboxylic acid salts, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkylpolyoxyethylene alkylphenyl ethers or polyoxyethylene alkyl phosphoric acid esters, etc.; amphoteric surface active agents such as amino acids, aminoalkylsulfonic acids, aminoalkyl sulfates or phosphates, alkylbetaines, amine imides or amine oxides, etc.; and cationic surface active agents such as alkylamine salts, aliphatic or aromatic quaternary ammonium salts, heterocyclic quaternary ammonium salts such as pyridinium or imidazolidium salts, etc., or aliphatic or heterocyclic phosphonium or sulfonium salts, etc.

Examples of these surface active agents include those described in U.S. Pat. Nos. 2,240,472, 2,831,766, 3,158,484, 3,210,191, 3,294,540 and 3,507,660, British Patent Nos. 1,012,495, 1,022,878, 1,179,290 and 1,198,450, Japanese Patent Application (OPI) No. 117,414/75, U.S. Pat. Nos. 2,739,891, 2,823,123, 3,068,101, 3,415,649, 3,666,478 and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publication Nos. 378/65, 379/65 and 13822/68, U.S. Pat. Nos. 2,271,623, 2,288,226, 2,944,900, 3,253,919, 3,671,247, 3,772,021, 3,589,906, 3,666,478 and 3,754,924, German Patent Application (OLS) No. 1,961,638 and Japanese Patent Application (OPI) No. 59025/75.

The photographic emulsions of the present invention may contain an aqueous dispersion of water-insoluble (or poorly soluble) synthetic polymers for the purpose of minimizing dimensional changes of the images to an extent which can be disregarded. Examples of polymers which can be used include polymers composed of one or more of an alkyl acrylate or methacrylate, alkoxyalkyl acrylate or methacrylate, glycidyl acrylate or methacrylate, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylate or methacrylate or styrenesulfonic acid, etc. For example, the polymers described in U.S. Pat. Nos. 2,376,005, 2,739,137, 2,853,457, 2,062,674, 3,411,911, 3,488,708, 3,525,620, 3,607,290, 3,635,715 and 3,645,740, and British Pat. Nos. 1,186,699 and 1,307,373 can be used.

Any known process can be employed for the photographic processing of the photographic emulsion of the present invention. Known processing solutions can be used. The processing temperature usually ranges from about 18° C. to about 50° C., but temperatures lower than about 18° C. or higher than about 50° C. may also be employed. Either development processing for forming silver images (black-and-white photographic processing) or color photographic processing comprising development processing for forming dye images may be employed.

The developer to be used for black-and-white photographic processing can contain a known developing agent. Suitable developing agents include, for example, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, etc.

In addition, the developer may contain a known preservative, an alkali agent, a pH buffer, an anti-fogging agent, etc., and, if desired, a dissolving aid, a toning agent, a development accelerator, a surface active agent, an anti-foaming agent, a water softener, a hardener, a viscosity-imparting agent, etc.

When developed with a developer containing about 0.15 mol/l or more, e.g., about 0.15 mol/l to about 1.2 mol/l of sulfite ion, the photographic emulsion of the present invention can provide a gamma of more than 10. The pH of the developer is preferably about 11 to about 12.3. When the pH exceeds about 12.3, the developer becomes unstable even though the concentration of sulfite ion is high, and stable photographic properties cannot be maintained after 3 days or longer.

A characteristic of the photographic emulsion of the present invention is that it can provide a gamma exceeding 10. However, a gamma of less than 10 (for example, 6 to 8) can also be obtained by changing the halide composition of the silver halide, emulsion layer thickness, the development conditions, etc., depending on the end-use. In such a case, too, it is possible to obtain the advantages of a high sensitivity, a thin film thickness, a good stability of the developer and the like. Therefore, light-sensitive materials in which the $\gamma$ is less than 10 after development also fall within the scope of the present invention.

A developer containing a fogging agent (development nuclei-forming agent) in an amount sufficient to substantially cause fogging is not used for developing the photographic emulsion of the present invention. Because, such a fogging agent partly provides in some cases a positive image.

In general, the developer may further contain a known preservative, an alkali agent, a pH buffer, an anti-fogging agent, etc., and, if desired, a dissolving aid, a toning agent, a development accelerator, a surface active agent, an anti-foaming agent, a sequestering agent, a hardener, a thickening agent, etc.

According to the process of the present invention, a gamma exceeding 10 can be obtained even with a developer containing more than about 0.15 mol/l of sulfite ion. In the process of the present invention, the pH of the developer must be about 11.0 to about 12.3, with a pH of 11.5 to 12.0 being preferred. If the pH exceeds 12.3, the developer is so unstable, even with a high level of sulfite ion concentration, that stable photographic properties cannot be maintained after 3 days or longer. In the process of the present invention, a developer containing a fogging agent (development nuclei-forming agent) in an amount sufficient to substantially cause fogging is not used, because such partly provides in some cases a positive image.

Those fixing solutions which are generally employed can be used in this invention. Organic sulfur compounds which are known to exhibit a fixing effect can be used as the fixing agent as well as thiosulfates and thiocyanates. The fixing solution may contain a water-soluble aluminum salt as a hardener.

Suitable preferred examples of fixing agents which can be used in the fixing solution include water-soluble thiosulfates such as sodium thiosulfate, potassium thiosulfate, ammonium thiosulfate, etc., water-soluble thiocyanates such as sodium thiocyanate, potassium thiocyanate, ammonium thiocyanate, etc., water-soluble organic diol fixing agents containing an oxygen atom or a sulfur atom such as 3-thia-1,5-pentanediol, 3,6-dithia-1,8-octanediol, 9-oxa-3,6,12,15-tetrathia-1,17-heptadecanediol, etc., water-soluble sulfur containing organic dibasic acids and water-soluble salts thereof such as ethylenebisthioglycollic acid and the sodium salt thereof, etc., imidazolidinethiones such as methylimidazolidinethione, etc. Further, the fixing agents described in L. F. A. Mason, *Photographic Processing Chemistry,* pages 187–188, Focal Press (1966) are also preferred.

The photographic emulsions are coated on conventional supports which do not undergo serious dimensional changes during processing. Typical supports which can be used are a cellulose acetate film, a polystyrene film, a polyethylene terephthalate film, a polycarbonate film, a laminate thereof, paper, baryta paper, paper coated or laminated with a hydrophobic polymer such as polyethylene, polypropylene, etc., as are commonly used for photographic light-sensitive materials. Transparent supports can be employed for certain end-uses of the light-sensitive material. Also, transparent supports may be colored by adding a dye or a pigment thereto as described in *J. SMPTE* 67, 296 (1958), etc.

Where adhesion between the support and the photographic emulsion layer(s) is insufficient, a subbing layer (an adhesive layer adhesive to both the support and the photographic emulsion layer(s)) is employed. Also, in order to improve the adhesion, the surface of the support may be subjected to a preliminary processing such as a corona discharge, irradiation with ultraviolet rays, flame treatment, etc. A suitable coating amount of silver is about 0.5 g/m$^2$ to about 10 g/m$^2$ of the support.

Various kinds of light sources such as a tungsten light, a halogen lamp, a mercury lamp, a xenon lamp, laser light, electron beams, or X-rays can be used for exposure. A suitable amount of exposure ranges from about $10^{-4}$ CMS to about $10^4$ CMS, preferably about $10^{-3}$ CMS to about $10^3$ CMS.

The present invention will now be described in more detail by the following non-limiting examples of preferred embodiments of the present invention.

EXAMPLE 1

An aqueous solution of a mixture of potassium bromide and sodium chloride and an aqueous solution of silver nitrate were simultaneously added to a gelatin solution maintained at 50° C. over a 50 minute period, during which time the pAg was maintained at 7.9. Thus, a silver chlorobromide emulsion containing 20 mol% silver chloride and having a mean grain size of 0.25$\mu$ was prepared. After removing soluble salts from the emulsion in a conventional manner, 43 mg of sodium thiosulfate was added thereto per mol of the silver chlorobromide and chemically ripened at 60° C. for 60 minutes. This emulsion contained 120 g of gelatin per mol of silver chlorobromide. The internal sensitivity of this emulsion was negligible as compared with the surface sensitivity thereof.

To this silver chlorobromide emulsion were added Compound (I-2) of the present invention and 5-methylbenzotriazole as shown in Table 1 below and, after adding thereto 2-hydroxy-4,6-dichloro-1,3,5-triazine sodium salt, as a hardener, the emulsion was coated on a cellulose triacetate film in an amount of 45 mg silver/100 cm$^2$ to prepare light-sensitive materials. Each sample was left for 14 days at room temperature (about 20°–30° C.) and, after exposure (200 CMS) for 1 second using an optical wedge, developed at 20° C. for 3 minutes using Developer (A) or Developer (B) described below. Subsequent processings were conducted in a usual manner.

| | Developer | |
|---|---|---|
| | (A) | (B) |
| N-Methyl-p-aminophenol hemisulfate (g) | 5 | 5 |
| Hydroquinone (g) | 10 | 10 |
| Sodium Sulfite (anhydrous) (g) | 75 | 75 |
| Sodium Metaborate (tetrahydrate) (g) | 30 | 30 |
| Potassium Hydroxide (g) | 15 | 12 |
| Water to make | 1 l (pH = 12.0) | 1 l (pH = 11.5) |

The photographic properties thus obtained are tabulated in Table 1 below. In Table 1, the relative sensitivity is indicated in terms of the relative value of the reciprocal of exposure amount providing a density of 2.0 above fog, taking the value of Sample 1 as 100.

TABLE 1

| Sample No. | Compound (I-2) (g/mol Ag) | Anti-Fogging Agent (g/mol Ag) | Relative Sensitivity | $\gamma$ | Fog |
|---|---|---|---|---|---|
| Processing A | | | | | |
| 1 | — | — | 100 | 5.0 | 0.56 |
| 2 | — | 1.0 | 65 | 4.8 | 0.14 |
| 3 | 0.4 | 1.0 | 148 | 7.1 | 0.12 |
| 4 | 1.3 | 1.0 | 240 | 11.0 | 0.16 |
| Processing B | | | | | |
| 1 | — | — | 100 | 4.9 | 0.33 |
| 2 | — | 0.5 | 65 | 4.9 | 0.33 |
| 3 | 0.4 | 0.5 | 63 | 5.0 | 0.10 |
| 4 | 1.7 | 0.5 | 129 | 8.1 | 0.09 |
| 5 | 5.1 | 0.5 | 220 | 17.0 | 0.10 |

As is clear from the results in Table 1, the photographic emulsion of the present invention provides a remarkably increased gamma and high sensitivity when processed with a stable developer of a pH of 11.5 or 12.0.

EXAMPLE 2

A sulfur-sensitized silver chlorobromide emulsion containing grains of a mean grain size of 0.25$\mu$ was prepared in the same manner as described in Example 1, and divided into 9 portions. Compound (I-1) and (I-3) of the present invention and Comparative Compounds (a) to (f) were added, respectively, to the emulsion before coating, and 0.5 g/mol Ag of 5-methylbenzotriazole and 2-hydroxy-4,6-dichloro-1,3,5-triazine sodium salt (0.4 g/100 g gelatin) were further added thereto, followed by coating in the same manner as described in Example 1. After leaving each sample for 14 days at room temperature, each sample was exposed (200 CMS) for 1 second using an optical wedge, and developed for 3 minutes at 20° C. using a developer having the following formulation. Subsequent photographic processings of fixing washing and drying were conducted in an ordinary manner.

| | |
|---|---|
| N-Methyl-p-aminophenol (hemisulfate) | 5 g |
| Hydroquinone | 10 g |
| Sodium Sulfite (anhydrous) | 75 g |
| Sodium Metaborate (tetrahydrate) | 30 g |
| Potassium Hydroxide | 15 g |
| Water to make | 1 l (pH = 12) |

The gamma values thus obtained are shown in Table 3 below.

TABLE 2

| Compound | Amount Added (g/AgBr/mol) |
|---|---|
| None | — |
| 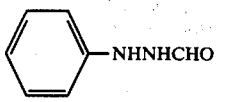 Compound (I-1) | 1.7<br>5.1 |
| 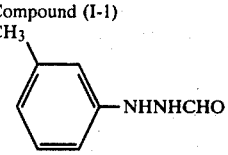 Compound (I-3) | 1.7 |
| 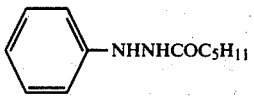 Comparative Compound (a) | 1.7<br>5.1 |
| 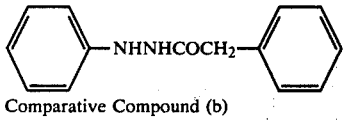 Comparative Compound (b) | 1.7<br>5.1 |
| 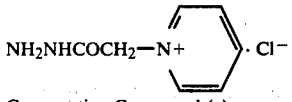 Comparative Compound (c) | 1.7<br>5.1 |
| $NH_2NHCOCH_2CH_2CONHNH_2$ Comparative Compound (d) | 1.7<br>5.1 |
| $NH_2NHCONHNH_2 \cdot HCl$ Comparative Compound (e) | 0.5<br>1.7 |
| 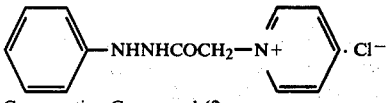 Comparative Compound (f) | 0.5<br>1.7<br>5.1 |

Comparative Compounds (d), (f) and (g) shown in Table 2 above correspond to compounds 14, 25 and 18, respectively, described in U.S. Pat. No. 2,419,975.

TABLE 3

| | Compound | Amount Added (g/mol Ag) | Relative Sensitivity | γ | Fog |
|---|---|---|---|---|---|
| Control | None | — | 100 | 4.8 | 0.14 |
| Present Invention | Compound (I-1) | 1.7 | 250 | 7.0 | 0.15 |
| | | 5.1 | 395 | 15.5 | 0.23 |
| " | Compound (I-3) | 1.7 | 520 | 12.5 | 0.15 |
| Comparison | Compound (a) | 1.7 | 95 | 5.1 | 0.16 |
| | | 5.1 | 93 | 5.3 | 0.16 |
| " | Compound (b) | 1.7 | 106 | 5.5 | 0.16 |
| | | 5.1 | 106 | 5.0 | 0.21 |
| " | Compound (c) | 1.7 | 101 | 5.0 | 0.34 |
| | | 5.1 | 75 | 5.5 | 0.26 |
| " | Compound (d) | 1.7 | 105 | 5.5 | 0.14 |
| | | 5.1 | 101 | 5.5 | 0.18 |
| " | Compound (e) | 0.5 | 120 | 5.5 | 0.61 |
| | | 1.7 | 105 | 5.5 | 0.52 |
| " | Compound (f) | 0.5 | 89 | 6.0 | 0.14 |
| | | 1.7 | 101 | 5.5 | 0.17 |
| | | 5.1 | 140 | 8.0 | 0.68 |

As is shown by the results in Table 3, the comparative compounds give rise to an extremely slight increase in gamma except for Comparison Compound (g) when used in an amount of 5.1 g/mol Ag. With respect to the sample containing Comparison Compound (g) showing an increased gamma, fog was generated to such a degree that such cannot be practically used. On the other hand, where the compound of the present invention was used, the gamma was remarkably increased with less fog.

EXAMPLE 3

1 liter of an aqueous solution containing 42 g of potassium bromide and 54 g of sodium chloride and 1 liter of a solution containing 200 g/l of silver nitrate were simultaneously added to 600 ml of a 3.5% (by weight) aqueous solution maintained at 60° C. to prepare a silver chlorobromide emulsion of a mean grain size of 0.3μ. This emulsion contained 30 mol% silver bromide. Soluble salts were removed employing a flocculation process and, after adding gelatin, the emulsion was chemically sensitized using sodium thiosulfate. The resulting emulsion contained 70 g of gelatin per mol of silver halide. The internal sensitivity of this emulsion was negligible as compared with the surface sensitivity thereof.

To this silver chlorobromide emulsion were added Compound (I-2) of the present invention and Compound (II-2) as shown in Table 4 below and, after further adding thereto 0.4 g of 2-hydroxy-4,6-dichloro-1,3,5-triazine sodium salt per 100 g of gelatin, the mixture was coated on a cellulose triacetate film support in an amount of 45 mg silver/100 $cm^2$. After exposure (200 CMS) for 1 second through an optical wedge using light from a tungsten lamp, each of the light-sensitive films was subjected to photographic processing using a developer having the formulation of Developer B described in Example 1. The photographic properties thus-obtained are shown in Table 4 below. In Table 4, specific sensitivity was determined in the same manner as in Example 1 (Table 1).

TABLE 4

| Film No. | Compound (I-2) (g/mol Ag) | Compound (II-2) (g/mol Ag) | Fog | Specific Sensitivity | γ |
|---|---|---|---|---|---|
| 1 | — | — | 0.8 | 257 | 4.2 |
| 2 | — | 0.5 | 0.12 | 100 | 3.8 |
| 3 | — | 1.7 | 0.05 | 72 | 3.2 |
| 4 | 2.7 | 0.5 | 0.50 | 560 | 6.0 |
| 5 | 2.7 | 1.7 | 0.06 | 270 | 7.5 |

In Table 4, Films No. 1 to 3 are comparative samples, and Films No. 4 and 5 correspond to the present invention. Comparative known emulsions have serious fog unless an antifogging agent is used and, when an antifogging agent is used, the sensitivity and gamma are decreased. The emulsions of the present invention exhibited a sensitivity 3 to 4 times higher than that of known emulsions having the same fog, and had a remarkably high gamma.

While the invention has been described in detail and with reference to specific embodiments thereof, it will be apparent to one skilled in the art that various changes and modifications can be made therein without departing from the spirit and scope thereof.

What is claimed is:

1. A negative image forming process which comprises imagewise exposing to light a photographic light-sensitive material comprising a support having thereon at least one silver halide photographic emulsion layer comprising substantially surface latent image monodispersed silver chlorobromide or silver chlorobromoiodide grains containing up to about 7 mol% silver iodide, wherein the average grain size of said silver halide grains is about 0.7 micron or less and a hydrophilic binder in an amount of about 250 g of less per mol of silver halide, wherein said silver halide photographic emulsion layer or at least one other hydrophilic colloid layer on said support contains a compound represented by the general formula (I):

$$R^1NHNHCHO \qquad (I)$$

wherein $R^1$ represents a phenyl group which may be unsubstituted or substituted with one or more alkyl groups, aralkyl groups, alkoxy groups, amino groups, acylamino groups or aromatic acylamino groups, and developing said photographic light-sensitive material with a developing solution containing a developing agent and about 0.15 mol/liter or more of sulfite ion and having a pH of about 11.0 to about 12.3.

2. The negative image forming process as set forth in claim 1, wherein the compound represented by the general formula (I) is:

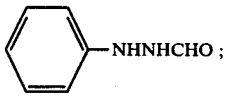

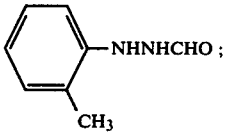

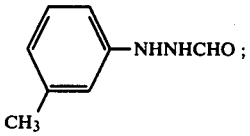

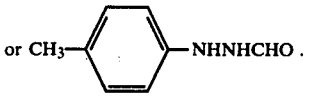

3. The negative image forming process as set forth in claim 1, wherein the compound represented by the general formula (I) is:

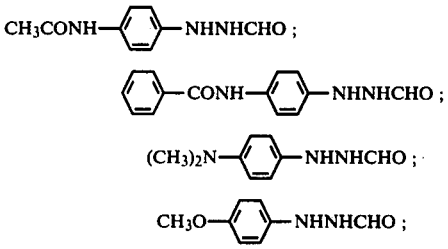

-continued

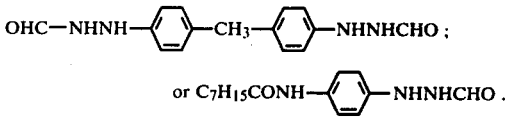

4. The negative image forming process as set forth in claim 1, wherein at least one benzotriazole compound is incorporated into a light-sensitive emulsion layer or a non-light sensitive hydrophilic colloid layer or is present in the developing solution.

5. The negative image forming process as set forth in claim 4, wherein said benzotriazole compound is present in said developing solution.

6. The negative image forming process as set forth in claim 22, wherein said benzotriazole is present in said light-sensitive emulsion layer.

7. The negative image forming process as set forth in claim 4, wherein said benzotriazole is present in said non-light sensitive hydrophilic colloid layer.

8. The negative image forming process is set forth in claim 4, wherein the benzotriazole compound is represented by the following general formula (II):

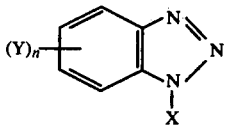

wherein Y represents an alkyl group, a halogen atom, an alkoxy group, an acyl group, an acylamino group, a carbamoyl group, a sulfamoyl group, or a monocyclic or bicyclic aryl group; n represents 0, 1 or 2; X represents a hydrogen atom, a halogen atom or an acyl group.

9. The negative image forming process as set forth in claim 8, wherein the benotriazole compound represented by the general formula (II) is 5-methylbenzotriazole.

10. The negative image forming process as set forth in claim 1, wherein the average grain size of said silver halide grains is about 0.4 micron or less.

11. The negative image forming process as set forth in claim 1, wherein the silver halide photographic emulsion contains at least one water-insoluble polymer.

12. The negative image forming process as set forth in claim 11, wherein the water-insoluble polymer is a polymer containing, as a monomer unit or units, a monomer unit or units of alkyl methacrylate, alkyl acrylate, alkoxyalkyl methacrylate, alkoxyalkyl acrylate, glycidyl methacrylate, glycidyl acrylate, methacrylamide, acrylamide, vinyl ester, acrylonitrile, olefin, styrene, or a combination thereof; or a combination of said monomer unit or units with a monomer unit or units of acrylic acid, methacrylic acid, $\alpha,\beta$-unsaturated dicarboylic acid, hydroxyalkyl methacrylate, hydroxyalkyl acrylate, sulfoalkyl methacrylate, sulfoalkyl acrylate or styrenesulfonic acid.

* * * * *